US005729212A

United States Patent [19]

Martin

[11] Patent Number: 5,729,212

[45] Date of Patent: Mar. 17, 1998

[54] GAMING DEVICE PROVIDING HIGH SECURITY COMMUNICATIONS WITH A REMOTE STATION

[75] Inventor: John R. Martin, Rockford, Ill.

[73] Assignee: Arachnid, Inc., Rockford, Ill.

[21] Appl. No.: 754,019

[22] Filed: Nov. 20, 1996

Related U.S. Application Data

[63] Continuation of Ser. No. 853,503, Mar. 18, 1992, abandoned.

[51] Int. Cl.[6] ..... G08B 23/00

[52] U.S. Cl. ..... 340/870.28; 340/825.35; 340/825.15; 340/825.27; 340/825.29; 340/323 R; 364/410; 463/1

[58] Field of Search ..... 340/870.28, 870.02, 340/825.35, 825.54, 825.15, 825.27, 825.29, 825.28, 323 R; 364/410; 463/1

[56] References Cited

U.S. PATENT DOCUMENTS

| | | | |
|---|---|---|---|
| 3,349,374 | 10/1967 | Gabrielson et al. | 340/825.15 |
| 4,366,481 | 12/1982 | Main et al. | 340/825.55 |
| 4,636,951 | 1/1987 | Harlick | 364/412 |
| 4,747,060 | 5/1988 | Sears, III et al. | 340/825.15 |
| 4,766,548 | 8/1988 | Cedrone | 364/410 |
| 4,837,728 | 6/1989 | Barrie et al. | 364/412 |
| 4,857,886 | 8/1989 | Crews | 340/323 R |
| 4,982,337 | 1/1991 | Burr et al. | 364/412 |

*Primary Examiner*—Donnie L. Crosland

*Attorney, Agent, or Firm*—McAndrews, Held & Malloy, Ltd.

[57] ABSTRACT

A gaming device is shown having one printed circuit board that includes a game control processor; at least one memory storing game operation information; and a light transmitter for transmitting encoded information representing selected game operation information that is stored in the memory. The gaming device also includes a communication printed circuit board that has a light receiver for receiving light encoded information from the light transmitter; at least one memory for storing game operation information as represented by the light encoded information received by the light receiver; and a communication controller that allows communication between the gaming device and a remote station. Because the light transmitter can transmit information to the communication board but cannot receive information therefrom, communications between the gaming device and a remote station is allowed without compromising the integrity or security of the operations of the gaming device.

17 Claims, 2 Drawing Sheets

GAMING DEVICE PROVIDING HIGH SECURITY COMMUNICATIONS WITH A REMOTE STATION

This is a continuation of application Ser. No. 07/853,503 filed Mar. 18, 1992, now abandoned.

TECHNICAL FIELD

The present invention relates to a gaming device and more particularly to a system that allows communication between the gaming device and a remote operator station to allow game operation information to be transmitted to the remote station while preventing the operation of the gaming device from being altered from the remote station.

BACKGROUND OF THE INVENTION

Gaming devices are known that allow communication between the gaming device and a remote station run by a jurisdictional authority, such as a State administrator. The jurisdictional authority typically requires that such communications be initiated only by the remote station and not by the gaming device. The restrictions on the communications between a gaming device and a remote station are to ensure the security and integrity of the gaming device operations. However, it is often desirable that the operator of the gaming device be able to communicate with the device from a remote location so that the operator can simultaneously monitor a number of gaming devices to ensure that they are operating without difficulty. Heretofore jurisdictional authorities have not allowed the operator to communicate with the gaming device from a remote location due to the risk that the operations of the device will be tampered with by downloading information to the device.

SUMMARY OF THE INVENTION

In accordance with the present invention, the disadvantages of prior gaming devices as discussed above have been overcome. The gaming device of the present invention includes a high security communication system that allows communications between a remote operator station and the gaming device while ensuring that the game controls of the device cannot be altered from the remote station.

More particularly, the gaming device of the present invention includes a game controller for controlling the operations of the gaming device and for monitoring the operations of the gaming device to provide information representative thereof. A first memory is coupled to the game controller for storing game operation information. A transmitter, is responsive to the game controller for transmitting encoded signals representing selected game operation information that is stored in the first memory. A receiver receives the encoded signals transmitted thereto to generate an electrical signal representative of the selected game operation information. A second memory is coupled to the receiver for storing the selected game operation information. A remote communication controller is provided for transmitting the game operation information stored in the second memory to a remote operator's station. The transmitter and receiver are preferably such as to allow the transfer of information in only a single direction so as to prevent access to the game controller via the communication controller. The transmitter and receiver may take the form of electro optical devices such as a LED and a photocell, although other devices restricting the direction in which information can be transferred may also be employed.

In a preferred embodiment, the game controller, first memory and transmitter are contained on a first printed circuit board and the receiver, second memory and communication controller are contained on a second printed circuit board there being no electrical connection between the two circuit boards to prevent tampering of the game controller via the communication channel with the remote operator station. The gaming device of the present invention thus allows an operator to monitor the operations of a gaming device from a remote location without compromising the integrity and security of the gaming device. These and other objects and advantages of the invention as well as details of an illustrative embodiment will be more fully understood from the following description and the drawings.

BEST MODE FOR CARRYING OUT THE INVENTION

Figure 1:
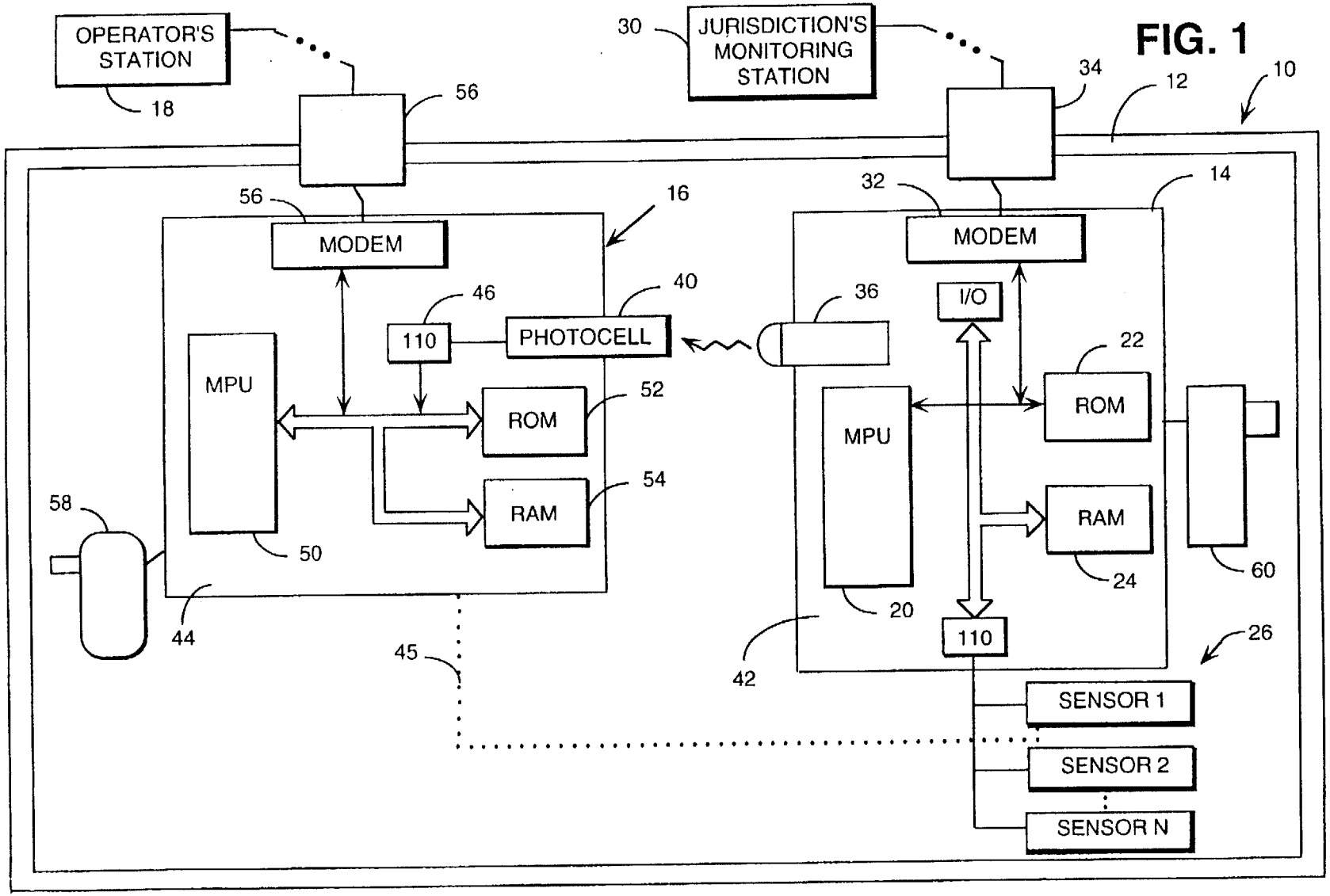
FIG. 1 is a block diagram of a gaming device in accordance with the present invention.

A gaming device 10 in accordance with the present invention includes a cabinet 12 for housing the game operation controls 14 and controls 16 to allow communications between the gaming device 10 and a remote operator station 18 without compromising the security or integrity of the game operation controls 14.

The controls 14 of the gaming device include a microprocessor 20 that operates in accordance with software and data respectively stored in a ROM 22 and a RAM 24 in order to control the operation of the gaming device. The microprocessor 20 also monitors various events concerning the operation of the gaming device via a number of sensors generally designated 26. The sensors 26 may include a door open sensor in order to detect when a door on the gaming device cabinet 12 is opened to indicate that someone has access to the controls 14. The sensors 26 may also include a sensor for detecting when a coin hopper or bill stacker is almost full. If the gaming device 10 includes a printer for providing a printed record of gaming events, a sensor 26 may be provided to generate a signal indicating that the available paper is almost depleted. These are just a few of the sensors that might be provided within the gaming device.

The microprocessor 20 is responsive to the signals received from various ones of the sensors 26 to store game operation event information representing the sensor signals in a RAM 24. The microprocessor 20 also stores history records in the RAM 24 wherein the history records include the time of occurrence of each win and the payout of that particular win, etc. Counter information is also stored in the RAM 24 under the control of the microprocessor 20. Such counter information includes for example the total coin or bill intake of the gaming device. The microprocessor further stores diagnostic and status information in the RAM 24. The diagnostic information or status information preferably includes an alarm flag indicating a sensed condition that warrants interruption of the operation of the gaming device or that warrants the immediate attention of the operator. For example, in response to a door open signal from a sensor 26, the microprocessor 20 prevents further operation of the gaming device 10 and stores in the RAM 24 an alarm flag indicating that the operation of the gaming device has been suspended due to a sensed open door condition.

In order to communicate with a remote jurisdictional authority's monitoring station 30, the controls 14 include a modem 32 that is coupled through a port 34 on the cabinet 12 to a local area network to which the monitoring station 30 is connected. The microprocessor 20 is programmed to allow communications with the remote station 30 to be initiated only by the remote station 30. However, to allow the microprocessor 20 to communicate information to the operator's station 18 without compromising the integrity of the controls 14, the controls 14 include a transmitter 36 that is capable of transmitting encoded information but that is not capable of receiving information, the transmitter 36 transmitting information as selected by the microprocessor 20 to the communication controls 16. The communication controls 16 then transmit the information to the operator station 18.

The transmitter 36 may be a LED that generates a light encoded signal representing the selected game operation information stored in the RAM 24 and the receiver 40 may be a photocell positioned with respect to the LED 36 so as to receive the light encoded signals transmitted from the LED 36. In response to a received light encoded signal, the photocell generates an electrical signal representative thereof.

The communication controls 16 include an input interface 46 coupled to the photocell 40 to buffer the data received, the input interface 46 being coupled to a microprocessor 50. The microprocessor 50 operates in accordance with software stored in a ROM 52 to store data representing the information received by the photocell 40 in a RAM 54. The microprocessor 50 further controls communications with the operator station. More particularly, the microprocessor 50 may initiate communications with the operator station 18 via a modem 56 and/or the operator station 18 may periodically poll the communications board 44 to allow the game operation information stored in the RAM 54 to be transmitted to the operator station 18. It is noted that the microprocessor 20, memories 22 and 24 and transmitter 36 are contained on one circuit board 42 while the microprocessor 50, memories 52, 54 and receiver are contained on a different circuit board 44, there being no direct electrical connections between the two boards. It is also noted that those sensors which are not integral to the operation of the game, such as the paper depletion sensor, may be directly coupled to the communication board 44 as indicated by the dotted line 45. Such an arrangement allows the microprocessor 50 to directly monitor various operations of the gaming device such as those operations relating to the maintenance of the device without compromising the integrity of the game operation controls 14. The communications board 44 may also have a power supply 58 separate from the power supply 60 of the game control board 42.

Figure 2:
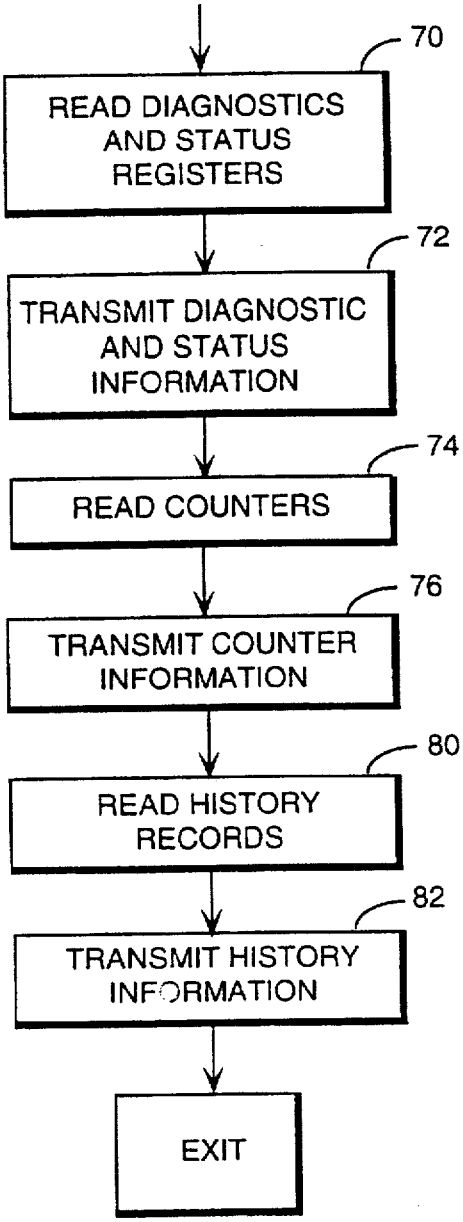
FIG. 2 is a flow chart illustrating a game controller routine for controlling the transmission of game operation information to a communication circuit board as depicted in FIG. 1.

The microprocessor 20 may periodically, at predetermined times or upon the occurrence of predetermined events control the light transmitter 36 to transmit selected information stored in the RAM 24 as discussed with respect to FIG. 2. More particularly, the microprocessor 20 at a block 70 first reads diagnostic and status information from the RAM 24. At block 72 the microprocessor 20 transmits the diagnostic and status information via the transmitter 36 with coded information representing the type of information being transmitted. Thereafter, at block 74 the microprocessor 20 reads the various counter registers in the RAM 24 and at block 76 the microprocessor 20 controls the transmission of the counter information with a coded word identifying the type of information via the transmitter 36. At a block 80, the microprocessor 20 reads any history records that might be stored in the RAM 24 and at block 82 the microprocessor transmits the history information with a coded word identifying the type of information via the transmitter 36.

Figure 3:
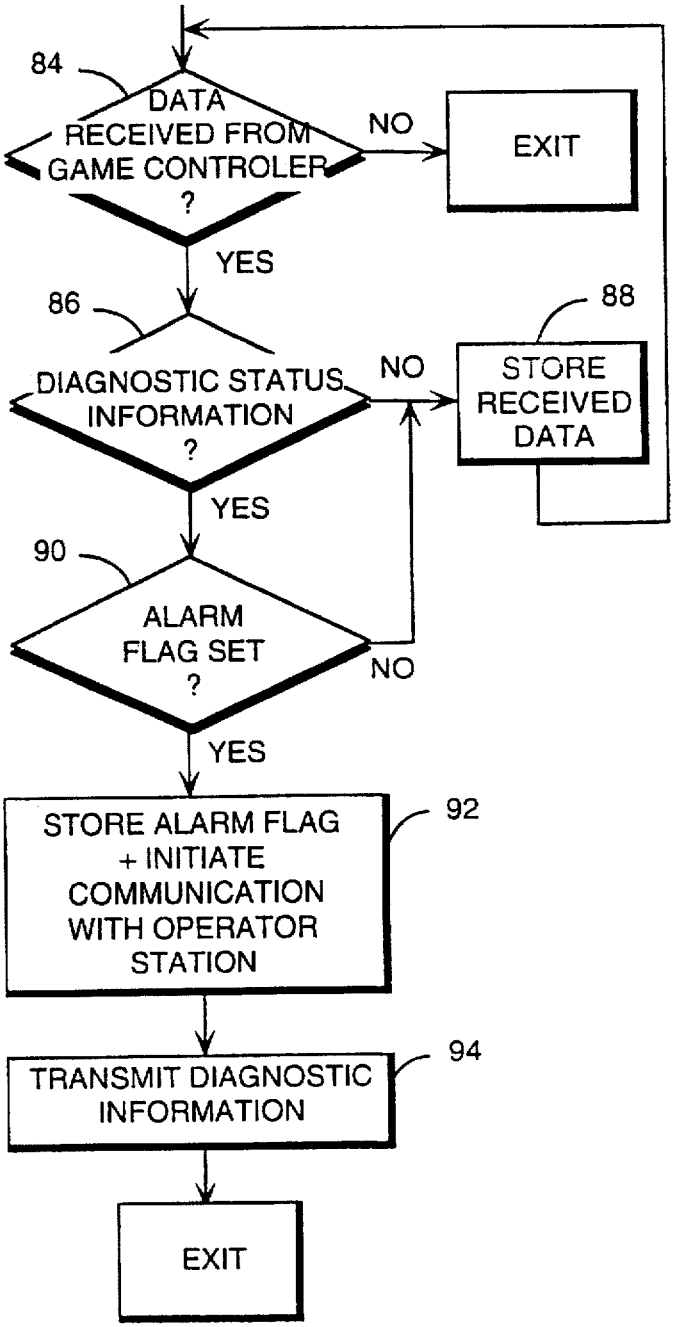
FIG. 3 is a flow chart illustrating a communication controller routine for receiving and storing data as well as for initiating communications with a remote operator station.

The microprocessor 50 of the communications controls 16, controls the storage of data received by the photocell 40 and initiates communications with the operator station 18 in accordance with a flow chart depicted in FIG. 3. More particularly, the microprocessor 50 at a block 84 determines whether information has been received from the game controls 14 and if so, proceeds to block 86. At block 86, the microprocessor 50 determines whether the information received is diagnostic or status information. If it is not, the microprocessor proceeds to block 88 to store the received information in particular locations in the RAM 54. If the microprocessor determines at block 86 that the information received by the photocell 40 is diagnostic/status information, the microprocessor 50 proceeds to block 90 to determine whether the information includes an alarm flag. If the information does not include an alarm flag, the microprocessor proceeds to block 88 to store the diagnostic/status information. If, however, the microprocessor 50 determines that an alarm flag is included in the diagnostic/status information, the microprocessor at a block 92 temporarily stores the alarm flag and initiates communications with the operator's station 18. Thereafter, the microprocessor at block 94 controls the transmission of data stored in the RAM 54 to the operator station 18. The microprocessor 50 is also responsive to a polling signal from the operator station 18 to transmit the information stored in the RAM 54 so that the operator can monitor the operation of the gaming device 10 remotely along with various other gaming devices under the operator's supervision.

The gaming device of the present invention thus allows an operator to be able to communicate with a gaming device from a remote location without compromising the integrity of the game controls 14. Since changes may be made in the above-described system without departing from the scope of the present invention, it is intended that the above description and drawings be interpreted as illustrative and not in a limiting sense.

We claim:

1. A gaming device comprising:

a game controller for controlling an operation of said gaming device and for monitoring the operation of said gaming device to provide game operation information representative thereof;

first storage means communicatively coupled to said game controller for storing game operation information;

a transmitter responsive to said game controller for transmitting encoded signals representing selected game operation information;

a receiver for receiving said encoded signals from said transmitter, said receiver being responsive to said encoded signals to generate an electrical signal representative of said selected game operation information;

second storage means communicatively coupled to said receiver for storing said selected game operation information;

first remote communication means communicatively coupled to said first storage means for transmitting game operation information stored in said first storage means to a first remote operator station; and second remote communication means communicatively coupled to said second storage means for transmitting game operation information stored in said second storage means to a second remote operator station, said second storage means being electrically isolated from said first storage means such that an operator at said second remote operator station cannot access said selected game operation information stored in said first storage means.

2. A gaming device as recited in claim 1 wherein said second remote communication means includes means for initiating communications with said second remote operator station.

3. A gaming device as recited in claim 1 wherein said second remote communication means includes means for receiving communications from said second remote operator station.

4. A gaming device as recited in claim 1 wherein said transmitter includes a light emitting diode and said receiver includes a photocell, said photocell being positioned with respect to said light emitting diode so as to receive light transmitted therefrom.

5. A gaming device as recited in claim 1 wherein said game operation information includes alarm information and said gaming device further includes a control means coupled to said receiver and responsive to the receipt of alarm information included in said game operation information for initiating communications with said second remote operator station.

6. A gaming device as recited in claim 1 wherein said game operation information includes information representing a plurality of different types of gaming information and said game controller selectively controls the type of game information to be transmitted by said transmitter at a given time, the game operation information transmitted by said transmitter including data identifying the type of game information being transmitted.

7. A gaming device comprising:

a game controller for controlling the operation of said gaming device and for monitoring the operation of said gaming device to provide game operation information representative thereof;

a first memory communicatively coupled to said game controller for storing said game operation information;

electro optical means responsive to said game controller for transmitting light encoded signals representative selected game operation information;

electro optical receiving means for receiving said light encoded signals from said transmitter, said receiving means being responsive to said encoded signals to generate an electrical signal representative of said selected game operation information;

a second memory communicatively coupled to said receiving means for storing said selected game operation information;

first remote communication means for transmitting game operation information stored in said first memory to a first remote operating station; and second remote communication means for transmitting game operation information stored in said second memory to a second remote operator station, said second memory being electrically isolated from said first memory such that an operator of said second remote operator station cannot access said selected game operation information stored in said first memory.

8. A gaming device as recited in claim 7 wherein said second remote communication means includes means for initiating communications with said second remote operator station.

9. A gaming device as recited in claim 7 wherein said second remote communication means includes means for receiving communications from said second remote operator station.

10. A gaming device as recited in claim 7 wherein said transmitting means includes a light emitting diode and said receiving means includes a photocell, said photocell being positioned with respect to said light emitting diode so as to receive light transmitted therefrom.

11. A gaming device as recited in claim 7 wherein said game operation information includes alarm information and said gaming device further includes a control means coupled to said electro optical receiving means and responsive to the receipt of alarm information included in said game operation information for initiating communications with said second remote operator station.

12. A gaming device comprising:

a gaming device control printed circuit board including a game control processor for controlling the operation of the gaming device, at least one first memory storing game operation information representing the operation of said gaming device, said first memory being coupled to said processor and a transmitter responsive to said processor for transmitting encoded information representing at least a portion of said stored game operation information;

a first communication controller coupled to said first memory for communicating with a first remote station; and a communication printed circuit board including a receiver for receiving said encoded information from said transmitter to generate an electrical signal representing said received information; at least one second memory coupled to said receiver for storing said received information; and a second communication controller coupled to said second memory for communicating with a second remote station to transfer said received information to said second remote station, said second memory not communicatively coupled to said first memory thus preventing an operator at said second remote station from accessing said game information.

13. A gaming device as recited in claim 12 wherein said communication controller includes means for initiating communications with said second remote station.

14. A gaming device as recited in claim 12 wherein said communication controller includes means for receiving communications from said second remote station.

15. A gaming device as recited in claim 12 wherein said transmitter includes a light emitting diode and said receiver includes a photocell, said photocell being positioned with respect to said light emitting diode so as to receive light transmitted therefrom.

16. A gaming device as recited in claim 12 wherein said game operation information includes alarm information and said communication controller includes means responsive to alarm information included in said received information for initiating communications with said second remote station.

17. A gaming device comprising:

a gaming device control circuit board for controlling the operation of said gaming device;

at least one sensor for detecting an event of said gaming device, said sensor providing gaming device event information representing a detailed event of said gaming device; and a communication circuit board comprising:

a first communication means communicatively coupled to said at least one sensor for receiving said gaming device information from said sensor, said first communication means including a first memory for storing said received gaming system event information and a first communication controller for communicating with a first remote station to transfer said received information to said first remote station; and a second communication means communicatively coupled to said at least one sensor for receiving said gaming device event information from said sensor, said second communication means including a second memory for storing said received gaming device event information and a second communication controller for communicating with a second remote station to transfer said received information to said second remote station, whereby said second remote station is prevented from accessing said gaming device control circuit board.

* * * * *